US006293538B1

(12) United States Patent
Niedzielski et al.

(10) Patent No.: US 6,293,538 B1
(45) Date of Patent: Sep. 25, 2001

(54) MAGNETIC SHEET FANNER

(75) Inventors: James H. Niedzielski, Fenton; Douglas K. Money, Flint, both of MI (US)

(73) Assignee: Atlas Technologies, Inc., Fenton, MI (US)

( * ) Notice: Subject to any disclaimer, the term of this patent is extended or adjusted under 35 U.S.C. 154(b) by 0 days.

(21) Appl. No.: 09/510,804

(22) Filed: Feb. 23, 2000

(51) Int. Cl.[7] ..... B65H 3/16
(52) U.S. Cl. ..... 271/18.1; 271/105; 271/901
(58) Field of Search ..... 271/18.1, 18.2, 271/105, 901

(56) References Cited

U.S. PATENT DOCUMENTS 1,716,602 * 6/1929 Ross ..... 271/18.1
2,847,212 * 8/1958 Stem ..... 271/18.1
2,848,227 * 8/1958 Gulick ..... 271/18.1
4,743,006 * 5/1988 Belle et al. ..... 271/18.1
5,651,541 7/1997 Prime .

* cited by examiner

*Primary Examiner*—H. Grant Skaggs
(74) *Attorney, Agent, or Firm*—Reising, Ethington, Barnes, Kisselle, Learman & McCulloch P.C.

(57) ABSTRACT

A magnetic fanner for providing a gap between stacked, magnetically permeable sheets has a housing formed of non-magnetically permeable material defining a sealed chamber within which a piston is reciprocable between a first position in which magnets carried by the piston are adjacent the stacked sheets to another position in which the magnets are remote from the stacked sheets. The piston is movable in response to the presence of unequal fluid pressures in the housing on opposite sides of the piston and pressurized fluid may be delivered to a selected side of the piston in controlled relation to the exhaust of pressure fluid from the opposite side of the piston. Pressure fluid delivery and exhaust is obtained via passages in rods which span the housing chamber and guide the piston during its movements.

8 Claims, 2 Drawing Sheets

MAGNETIC SHEET FANNER

This invention relates to a magnetic fanner of the kind adapted to provide separation between magnetically permeable sheets arranged in a stack to facilitate the removal of the uppermost sheet from the stack.

BACKGROUND OF THE INVENTION

In the reforming of metal sheets arranged in a vertically extending stack it is common to remove the uppermost sheet from the stack and transfer it from the stack to another position where the sheet may undergo reforming procedures. If the confronting surfaces of the stacked sheets are smooth or have a film of lubricant thereon it sometimes is difficult to separate the upper-most sheet from the stack. This problem can be overcome by providing a magnetic field adjacent the upper end of the stack of sheets so as to provide a gap between the upper sheets, thereby facilitating the separation of the uppermost sheet from the remainder of the stack. Apparatus for accomplishing this objective is illustrated in a number of prior patents, of which U.S. Pat. No. 5,651,541 is illustrative and the disclosure of which is incorporated herein by reference.

It is preferred to use permanent magnets, rather than electromagnets, for the creation of the magnetic field because permanent magnets are less expensive and require less maintenance. In those instances in which the permanent magnets are very powerful, however, it sometimes is difficult to effect movement of the magnets in a direction away from the stacked sheets because the magnetic attraction is so great. Because of the power of the magnets the force which must be applied to move the magnets in a direction away from the stack of sheets may be greater than that which can be provided without risking damage to the fanner construction, or to the edges of stacked sheets, or both.

It is the object of this invention, therefore, to provide apparatus which can generate adequate force to effect controlled movements of very powerful magnets and in such manner as to minimize the possibility of damage resulting from such movements.

SUMMARY OF THE INVENTION

Magnetic fanner apparatus constructed in accordance with the preferred embodiment of the invention comprises a housing within which a piston of large surface area is reciprocable between a projected position in which the piston is adjacent a stack of sheets to a retracted position in which the piston is remote from the stack of sheets. On that face of the piston which confronts the stacked sheets are secured one or more powerful, rare earth permanent magnets. In the projected position of the piston the magnets are closely adjacent the stacked sheets, whereas in the retracted position the magnets are spaced sufficiently far from the stacked sheets as to exert relatively little attractive force on such sheets.

The piston is a double acting piston and has a seal between itself and the interior walls of the housing so that unequal pressures may exist on opposite sides of the piston for the purpose of effecting movement of the piston in a selected one of two opposite positions.

A source of pressurized fluid is coupled to rods which extend fore and aft of the housing and through the piston to provide support and guides for the piston during its movements. The rods are provided with fluid passages and appropriately placed ports through which pressurized fluid may pass into and out of the housing in such manner as to effect movements of the piston and the magnets supported thereby.

In the preferred embodiment the movements and positions of the piston and the magnet are controlled solely by the pressurized fluid, thereby dispensing with the need for springs. The rate of movement of the piston can be controlled by regulating the flow of pressurized fluid to and from opposite sides of the piston thereby avoiding such rapid movement of the piston as to cause damage.

THE DRAWINGS

The presently preferred embodiment of the invention is disclosed in the following description and in the accompanying drawings wherein.

THE PREFERRED EMBODIMENT

Figure 2:
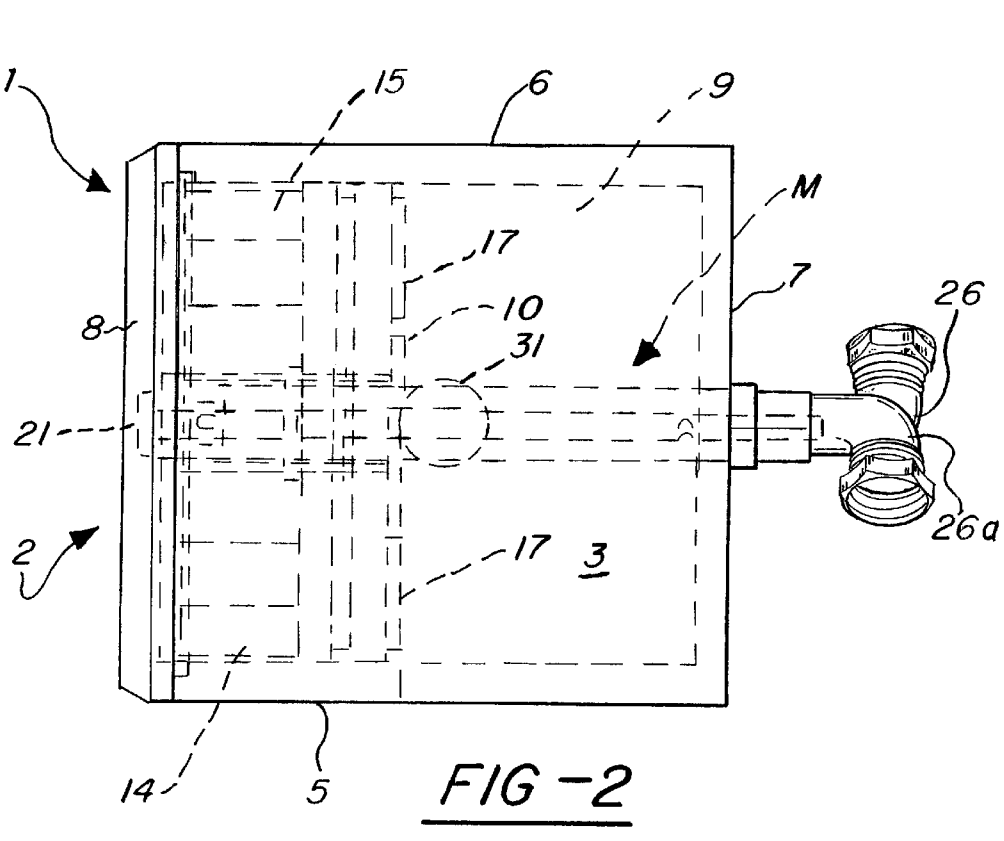
FIG. 2 is a top plan view, on an enlarged scale, of the housing and its contents.
Figure 1:
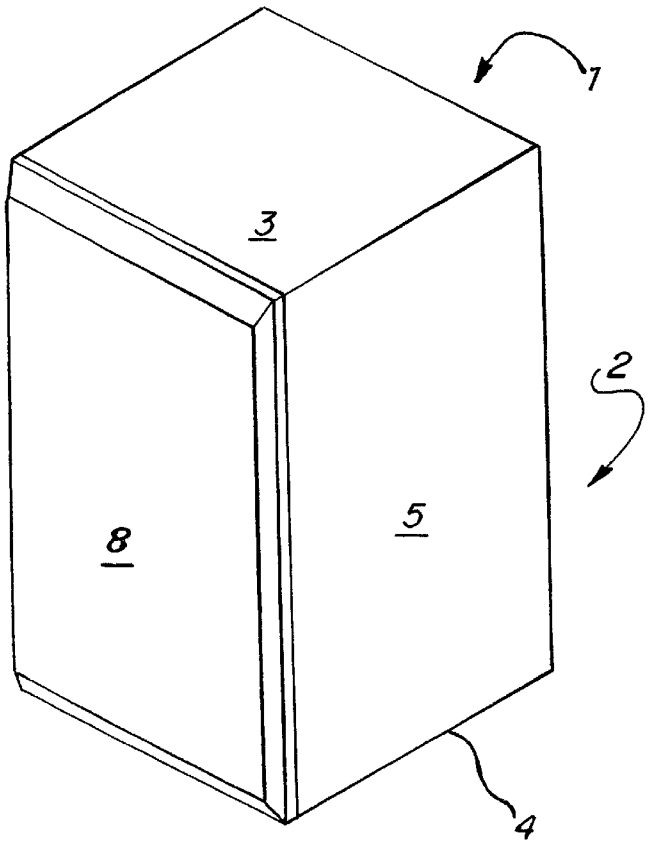
FIG. 1 is an isometric view of a housing within which the piston and magnets are positioned.
Figure 4:
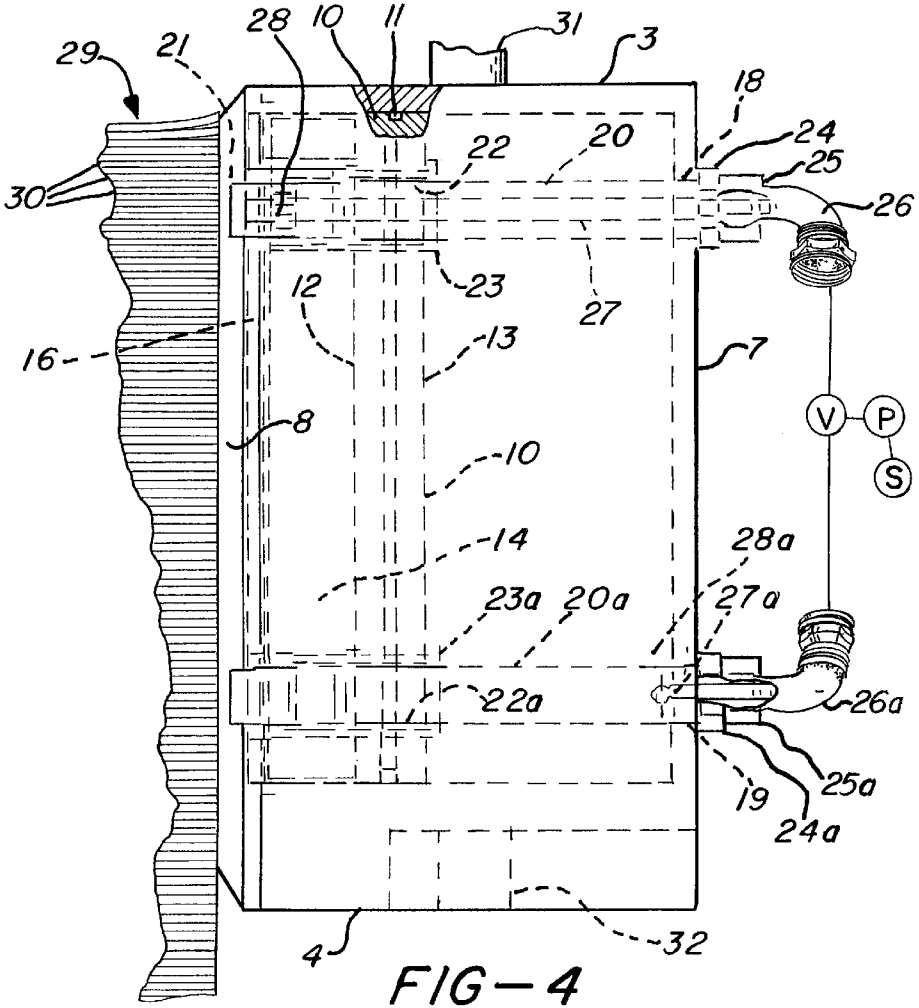
FIG. 4 is a side elevational view.
Figure 3:
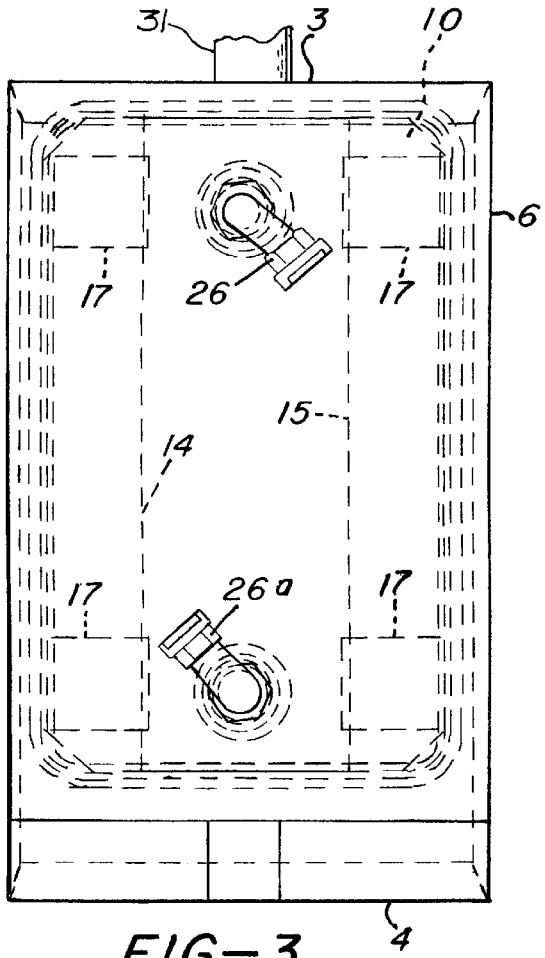
FIG. 3 is a rear elevational view.

The magnetic fanner apparatus is designated generally by the reference character 1 and comprises a housing 2 having a top wall 3, a bottom wall 4, opposed side walls 5 and 6, a rear wall 7, and a front wall 8. The housing is formed from non-magnetically permeable material. The front wall 8 is preferably thinner than the other walls. As shown, the housing 1 is rectangular, but it could be square, circular, or any other appropriate configuration.

The walls of the housing provide an inner chamber 9 within which is a reciprocable piston 10 having a groove in its periphery and in which is accommodated a sealing ring 11 that provides a seal between the piston 10 and the walls of the chamber. The opposite surfaces of the piston preferably are planar and coextensive in area.

To the forward face 12 of the piston, i.e., the face which confronts the front wall 8, is secured a pair of preferably rare earth, permanent magnets 14 and 15. The magnets may be secured to the piston adhesively or in any other suitable manner. However, the magnets preferably are spaced apart symmetrically on opposite sides of the vertical centerline of the housing. The forward surfaces of the magnets are provided with cushioning pads 16 and the rear surface 13 of the piston is provided with similar cushioning pads 17. The cushioning pads 16, 17, if desired, could be fixed to the inner surfaces of the housing walls 7 and 8.

Mounting means M supports the piston 10 for reciprocating movements fore and aft of the chamber 9. The mounting means includes a pair of vertically spaced apart apertures 18 and 19 in the rear wall 7 which are located on the vertical center line of the housing 2. Extending through the aperture 18 is an elongate support rod 20 the forward end of which is fitted into a recess 21 formed in the rear face of the front wall 8. The support rod 20 extends through an opening 22 in the piston 10 and such opening is provided with a slideable, sealing bushing 23. The rod 20 is secured to the housing by suitable fittings 24 and 25 which couple the rod to a pressure fluid conduit 26. The conduit 26 communicates with an axial fluid passage 27 in the rod 20 and such passage communicates with ports 28 at the forward end of the rod.

Beneath the rod 20 is a support rod similar to the rod 20. Corresponding parts are identified by corresponding reference character having the suffix a. The rod 20*a* extends through an aperture 19 and differs from the rod 20 in that the second conduit 26*a* communicates with a shorter axial passage 27*a* and with ports 28*a* within the chamber 9 adjacent the rear wall 7.

The conduits 26 and 26*a* communicate with a source 5 of pressure fluid via a fluid pressure pump P and an appropriate 3- or 4-way valve V of conventional construction which is capable of directing pressure fluid into the chamber 9 at a selected side of the piston 10 and enabling fluid to be exhausted from the chamber at that side of the piston opposite the side to which pressure fluid is admitted.

In the operation of the apparatus the housing 2 may be positioned and supported in any suitable manner adjacent the upper end of a stack 29 of magnetically permeable sheets 30 so that, when the magnets 14 and 15 are in a position closely adjacent the inner surface of the housing front wall 8, the uppermost sheet or sheets of the stack will be fanned or separated, thereby enabling sheet transfer apparatus (not shown) of conventional construction to lift the uppermost sheet from the stack. The top and bottom walls of the housing may be provided with projecting studs 31 and 32, respectively, which may be accommodated in openings of a mounting fixture to enable the housing to oscillate and conform to a stack of sheets which may not have straight edges.

Whenever it is desired to minimize the magnetic attraction exerted by the magnet on the sheet 30*s*, the valve V will be actuated to enable pressurized fluid to pass through the conduit 26, the passage 27, and the ports 28 into that part of the chamber 9 between the inside of the housing wall 8 and the forward surface 12 of the piston 10. At the same time, fluid from the chamber 9 on the opposite side of the piston may be exhausted through the ports 28*a* into the passage 27*a* and through the conduit 26*a* to atmosphere, if the pressurized fluid is air, or to a reservoir if the pressurized fluid is liquid. There thus will be established differential pressures in the chamber on opposite sides of the piston of such magnitude as to cause the piston to move in the direction of the lower pressure. When the piston moves in a direction away from the wall 8 the magnets will move away from the stacked sheets. Since the force that a permanent magnet exerts on a magnetically permeable object is inversely proportional to the distance between the magnet and such object, the extent of movement of the magnets away from the front wall of the housing should be sufficient to enable a stack of magnetically permeable sheets to be moved into and out of engagement with the front wall without being affected substantially by the magnets. The maximum distance the piston may be moved away from the stacked sheets is determined by the fore and aft length of the chamber 9.

When it is desired to relocate the magnet in a position adjacent the stacked sheets 30, the valve V may be adjusted to enable pressurized fluid to enter the conduit 26*a* and pass through the ports 28*a* into that part of the chamber between the piston and the rear wall 7. At the same time, pressurized fluid on the opposite side of the piston may be exhausted through the ports 28 and the passage 27 into the conduit 26 for discharge thereby establishing differential pressures on opposite sides of the piston. The piston 10 will be acted on by the pressure of the fluid in the rear part of the chamber 9 and move toward the front wall 8, thereby relocating the magnets in a position to fan or separate the uppermost sheets.

Movements of the piston are guided by the rods 20, 20*a*. These rods, therefore, perform not only the functions of delivering pressure fluid, but also guiding and stabilizing the piston and the magnets during their movements. The effective surface area on opposite sides of the piston 10 preferably is uniform so that the force required to move the piston in either direction will be substantially the same. The surface area should be sufficient to enable the piston not only to move in the selected direction, but also to remain in that position as long as the pressure of the fluid on the high-pressure side of the piston is maintained.

Preferably, the effective surface area of the piston is such as to enable the attractive force exerted by the magnet on the stacked sheets to be overcome without the use of excessively high differential pressures. The surface area and the necessary pressures can be calculated quite easily with reference to the size and magnetic strength of the magnets.

The rate at which pressurized fluid is introduced to and withdrawn from the chambers on opposite sides of the piston can be controlled quite easily by means of an appropriate valve V, thereby avoiding rapid movement of the piston and magnets and the generation of such force as to damage any of the parts of the apparatus.

Another advantage of the disclosed construction is that movements of the piston and the magnets do not rely upon or require the presence of any springs. As a consequence, no spring force must be overcome or compensated for regardless of the direction of movement of the piston and the magnets.

This disclosure is representative of the presently preferred embodiment of the invention, but is intended to be illustrative rather than definitive thereof. The invention is defined in the claims.

We claim:

1. A magnetic sheet fanner construction comprising a housing having walls defining a chamber; a piston; means mounting said piston in said chamber for movements in opposite directions from a first position in which one side of said piston confronts and is adjacent one wall of said housing to a second position in which said piston is remote from said one wall; at least one permanent magnet carried by said piston at said one side thereof; a source of pressure fluid; means for delivering pressure fluid from said source into said chamber at a selected side of said piston and exhausting pressure fluid from said chamber at the opposite side of said piston; and valve means for controlling the delivery and exhaust of said pressure fluid to and from said chamber in such manner as to effect conjoint movement of said piston and said magnet in a selected one of either of said directions.

2. The construction according to claim 1 wherein said mounting means comprises a pair of support rods spanning said chamber, and wherein the means for delivering and exhausting pressure fluid from said chamber comprises a fluid passage in each of said rods, the passage in one of said rods communicating with said chamber at said one side of said piston and the passage in the other of said rods communicating with said chamber at the opposite side of said piston.

3. The construction according to claim 2 including sealing bushings interposed between said piston and the respective support rods.

4. The construction according to claim 2 wherein the passage in said one of said rods communicates with said chamber closely adjacent said one wall of said housing and the passage in the other of said rods communicates with said chamber adjacent that wall of said housing opposite said one wall.

5. The construction according to claim 1 wherein said walls are formed of non-magnetically permeable material.

6. A magnetic sheet fanner construction comprising a hollow housing having walls defining a sealed chamber; a piston; means mounting said piston in said chamber for reciprocable movements from a first position adjacent one wall of said housing to a second position adjacent a wall opposite and spaced from said one wall; at least one permanent magnet carried by said piston at that side thereof which confronts said one wall of said housing, said mounting means comprising a pair of spaced apart supports spanning said chamber from said one wall to said opposite wall and extending through said pistons; a source of pressure fluid; conduit means for delivering fluid from said source to corresponding ends of said supports externally of said chamber; a first fluid passage in one of said supports and communicating with said source for conducting pressure fluid from said source into said chamber adjacent said one of said walls; a second fluid passage in the other of said supports and communicating with said source for conducting pressure fluid from said source into said chamber adjacent the other of said walls; and valve means operable to introduce pressure fluid into said chamber via one of said passages and exhaust pressure fluid from said chamber via the other of said passages, thereby establishing differential pressures on opposite sides of said piston and effecting movement of said piston in a selected direction relative to said chamber.

7. The construction according to claim 6 wherein said supports are substantially uniform in length and wherein said first fluid passage is of such length as to communicate with said chamber closely adjacent said one wall and wherein the second fluid passage is of such length as to communicate with said chamber closely adjacent said opposite wall.

8. The construction according to claim 7 wherein each of said passages extends longitudinally of the associated support and wherein each of said passages terminates within said chamber in lateral ports.

* * * * *